US005358202A

United States Patent [19]

Tse et al.

[11] Patent Number: 5,358,202

[45] Date of Patent: Oct. 25, 1994

[54] CAB SIGNAL TRACK CODE ANALYZER SYSTEM

[75] Inventors: Terry H. Tse, Ambler, Pa.; Roger M. St. Martin, Willingboro; Donald C. Oltmann, Sewell, both of N.J.; James P. Miccolis, Upper Darby, Pa.; James M. Harris, Richboro, Pa.; Joseph F. Dolan, Philadelphia, Pa.; James F. Brady, Tyrone, Pa.

[73] Assignee: Consolidated Rail Corporation, Philadelphia, Pa.

[21] Appl. No.: 918,847

[22] Filed: Jul. 21, 1992

[51] Int. Cl.[5] ..... B61L 23/00

[52] U.S. Cl. ..... 246/34 R; 246/167 R

[58] Field of Search ..... 246/34 R, 34 B, 34 CT, 246/40, 62, 63 R, 63 C, 28 F, 167 R, 169 R, 180, 191

[56] References Cited

U.S. PATENT DOCUMENTS

| | | | |
|---|---|---|---|
| 4,320,881 | 3/1982 | Campbell | 246/34 B |
| 4,467,270 | 8/1984 | McElroy et al. | 246/28 F X |
| 4,494,717 | 1/1985 | Corrie et al. | 246/28 F |
| 4,742,460 | 5/1988 | Hollands | 246/167 R X |
| 4,868,538 | 9/1989 | Ballinger et al. | 246/167 R X |
| 4,885,689 | 12/1989 | Kane et al. | 246/167 R X |
| 4,904,939 | 2/1990 | Mian | 246/169 R X |

*Primary Examiner*—Michael S. Huppert
*Assistant Examiner*—Scott L. Lowe
*Attorney, Agent, or Firm*—Woodcock Washburn Kurtz Mackiewicz & Norris

[57] ABSTRACT

A track code analyzer is disclosed that measures the duty cycle, carrier frequency, modulation frequency, and amplitude of track code signal and determines when these parameters are outside predetermined limits. The system also detects and records transient anomalies in the track code. The track code analyzer of the present invention is either mounted on a railway vehicle or used as a portable, wayside troubleshooting device. In a preferred embodiment, apparatus for processing a track code signal for indicating track conditions is provided that comprises a pickup for inductively receiving and decoding an analog track code signal. The signal is preferably received and processed by a conditioning circuit for processing the analog track code signal and transmitted to an analog-to-digital (A/D) converter for creating a digital track code signal. The digitized signal is then input to a first processor for computing a value from the digital track code signal and transmitting an output signal indicative of the value. The first processor is preferably a microprocessor for taking data from the analog-to-digital converter and determining signal level, carrier frequency, modulation frequency, and duty cycle of the track code. The output signal is transmitted to an apparatus for displaying the value, such as one or more light emitting diodes, so that the track conditions are displayed.

18 Claims, 4 Drawing Sheets

CAB SIGNAL TRACK CODE ANALYZER SYSTEM

The present invention relates to analyzing analog signals, and, more specifically, the present invention relates to analyzing the track code signals carried in railway rails.

BACKGROUND OF THE INVENTION

In North America, train movement on mainline tracks is typically governed by fixed wayside signals. An enhancement of this system is the coded cab signal system utilized by carriers in areas that have a high traffic density. The coded cab signal system displays the current track signal aspect to the crew in the cab of the leading locomotive by inductively receiving and decoding a coded electrical signal in the rail. Typically, there are four signal aspects displayed, each indicating the condition of the upcoming track, such as whether there is another train or a divergent route ahead. Each of the four signal aspects has an associated maximum speed at which the locomotive may safely travel into the upcoming section of track. From the highest allowable speed to lowest, the four aspects are generally named: "clear", "approach-medium", "approach", and "restricting." The coded signal traveling within the track is typically a modulated 100 Hz signal, although other frequencies are sometimes used. The 100 Hz carrier signal is switched on and off, or modulated, at various rates to represent each signal aspect. Typical nominal modulation rates measure in cycles per minute are: clear =180 (3.00 Hz); approach-medium =120 (2.00 Hz); approach =75 (1.25 Hz); and restricting =no code (0.0 Hz). The nominal on/off duty cycle for the modulations is typically 50% on, 50% off, i.e., a 50% duty cycle.

The current of the 100 Hz signal in the rail induces a similar 100 Hz signal on the locomotive's receiver coils which are located above each rail. This induced signal is amplified and decoded either through the use of tuned relays or digital signal analysis to provide output to the cab signal display in the locomotive cab. The duty cycle, carrier frequency, modulation frequency, and amplitude of the track code all have tolerance bands associated with their nominal values. Operation of the system outside of these tolerances can result in erroneous, albeit more restrictive, signal indications being displayed in the locomotive cab.

Malfunctioning or marginal track code generating equipment usually causes incorrect signal indication, typically resulting in a "restricting" indication in the locomotive cab when a more favorable aspect should be displayed. Any downward change in signal aspect sounds an alarm and requires that the engineer acknowledge the change by stepping on a pedal. If the acknowledging pedal is not depressed within a specified time period, the train's brakes will automatically be applied. Besides unnecessarily delaying the train, unplanned applications of the brakes can cause high dynamic forces which, under the right conditions, can lead to a derailment. Since malfunctioning or marginal track code generating equipment usually causes a downward change in cab signal indication when one isn't expected, the proper functioning of the wayside track code generating equipment is essential for safe and efficient train operation.

Currently, deficient track code is only detected when the train crew notices the cab signal display showing the wrong aspect. Often the display will "flip" to a more restricting aspect and then "flip" back to the proper one, i.e., the signal aspect drops and returns to a higher indication in a short time. When this occurs, the operator does not know if the defect resides with the wayside equipment or the locomotive-mounted equipment. Once a problem has been reported, signal maintenance personnel must conduct testing of the wayside equipment to determine if the problem exists in that equipment. This is done by simulating train movements by lining switches and clearing signals with no trains present and then progressively shunting the track circuits in the route with an AC ammeter. The ammeter indication is then interpreted to determine the cab signal current and code rate.

In some cases, specialized devices have been developed to automatically determine the code rate, but the test procedure is essentially the same. Tests are normally preformed at the time of initial installation or modification of the signal system and at specified, periodic intervals and are intended to show the system is functioning as intended.

The above described methods for ascertaining the cause of a "flip" have four fundamental limitations. First, the tests do not measure certain parameters, such as the carrier frequency. Second, the tests are essentially static and do not give a good picture of transient conditions such as when a train passes from one track circuit to another at a high rate of speed. Third, the tests are simulations and not actual train movements and, therefore, many flips are not detectable with this method. Fourth, the wayside equipment is not tested between the specified test periods unless trouble is reported from a train.

SUMMARY OF THE INVENTION

A track code analyzer has been developed to measure the duty cycle, carrier frequency, modulation frequency, and amplitude of the track code signal and determine when these parameters are outside predetermined limits. The system is also capable of detecting and recording transient anomalies in the track code. The track code analyzer of the present invention is capable of being mounted on a railway vehicle or used as a portable, wayside troubleshooting device.

In a preferred embodiment of the present invention, apparatus for processing a track code signal for indicating track conditions is provided that comprises a pickup for inductively receiving and decoding an analog track code signal. The signal is preferably received and processed by a conditioning circuit for processing the analog track code signal and transmitted to an A/D converter for creating a digital track code signal. Preferably, a power supply is connected to at least the conditioning circuit and the converter. The digitized signal is then input to a first processor for computing a value from the digital track code signal and transmitting a first output signal indicative of the value. The first processor is preferably a microprocessor for taking data from the analog-to-digital converter and determining signal level, carrier frequency, modulation frequency, and duty cycle of the track code. The output data are transmitted to an apparatus for displaying the value, such as one or more light emitting diodes, so that the track conditions are displayed.

The apparatus also preferably includes a clock, so that the processor can compute a value at a plurality of predetermined times governed by the clock. In certain preferred embodiments of the apparatus of the present invention, a second processor is connected to the clock, and the second processor is configured to receive an input from the A/D converter and continuously sample and store the last 10 seconds of raw data in a gapless rolling buffer. If an anomaly is present—as determined by the host computer—this processor will transfer these 10 seconds of data to the host computer to be stored as a computer file for later analysis. Finally, in many instances it will be desirable to add a third processor configured to receive an input from the cab unit, determine the presence of a signal flip and create a third output signal indicative of the signal flip.

In a most preferred embodiment of the present invention, the three processors are connected to the cab unit and a system computer via a local area network, wherein the first, second and third output signals are transmitted along the local area network to the system computer. Such embodiments further preferably include a communication interface connected to the local area network for converting the first, second and third output signals into a form compatible with an RS 232 serial communication device.

In a preferred embodiment of a circuit used in the present invention, a band pass filter is connected to the pickup, and has an output connected to the conditioning circuit. The conditioning circuit itself preferably comprises a differential amplifier for amplifying the analog track code signal, a notch filter connected to an output signal from the differential amplifier, and a variable gain amplifier connected to the output of the notch filter. The notch filter is most preferably tuned to 60 Hz. The circuit also preferably includes an isolation amplifier for creating high input impedance, non-loading tap of the pickup coil that has a low impedance output, thereby providing noise immunity from inductive interference, the isolation amplifier is connected to the pickup and the power supply, and has an output comprising the analog track code signal.

DETAILED DESCRIPTION OF THE PREFERRED EMBODIMENTS

The track code analyzer of the present invention is not a replacement for the periodic testing described above, but enables the diagnosis and repair of track code generating equipment before it deteriorates to the point where it causes flips, i.e., before the occurrence of conditions where the signal aspect drops and returns in a short time. The present invention also permits the detection of transient problems, such as variations in cab signal frequency when a train enters a particular track circuit, that the current test method is incapable of measuring. By incorporating the present invention into a locomotive or other railway vehicle, track circuits can be checked and diagnosed each time the vehicle passes over each track circuit.

Figure 1:
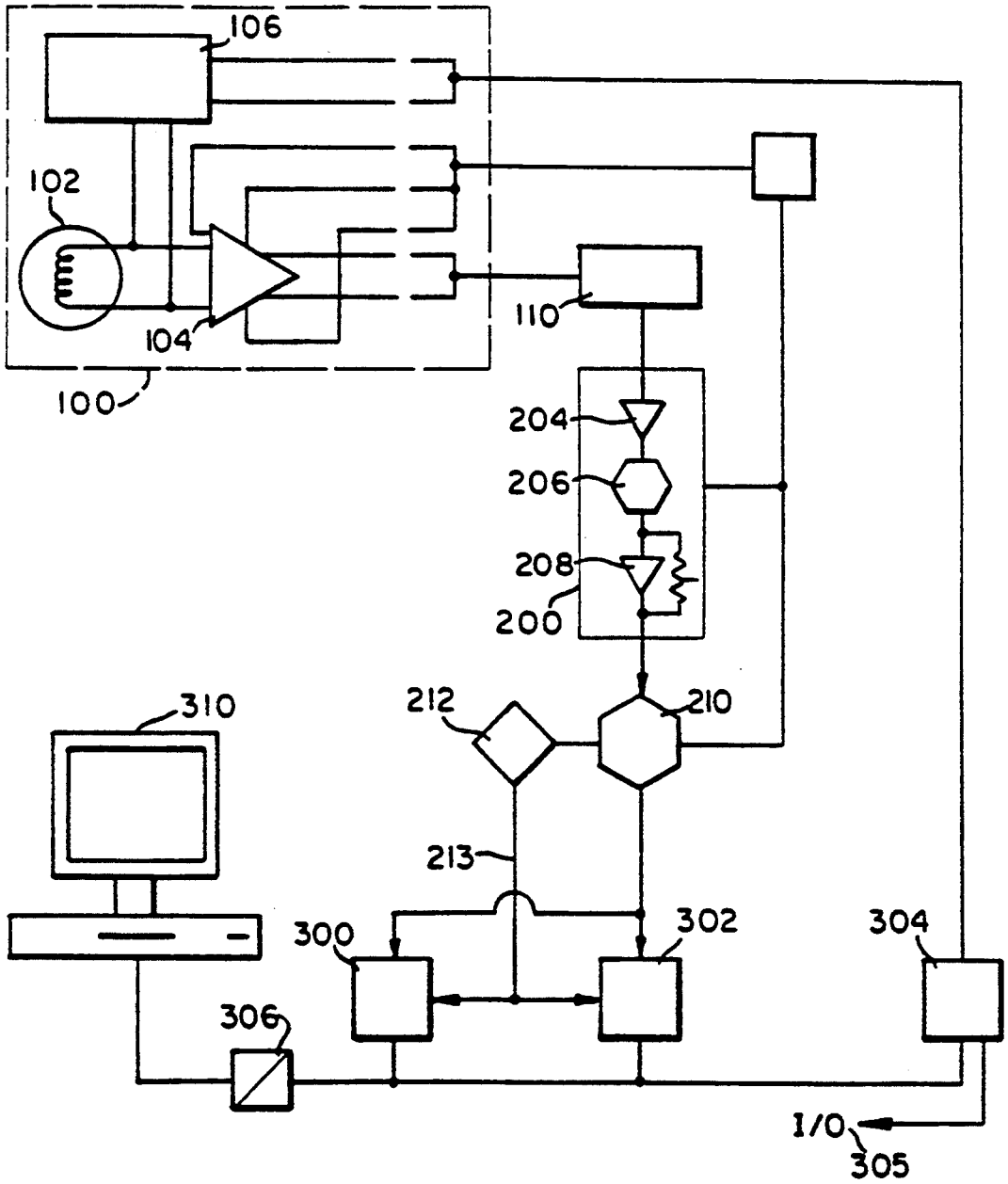
FIG. 1 is a schematic representation of a preferred embodiment of the present invention.

A partially schematic, partially diagrammatic diagram of a track code analyzer made in accordance with the present invention is shown in FIG. 1. One portion of the apparatus of the present invention comprises a cab portion 100 that is located within the cab of a locomotive, or, in certain embodiments, forms an external interface for a portable unit. The cab portion 100 comprises a pickup coil 102 for inductively coupling with a rail to detect the track code therein. In a preferred embodiment, the pickup coil 102 is connected to an isolation amplifier 104 that is attached to the cab signal receiver bars on a locomotive or other railway vehicle. The high input impedance of the coil 102 allows the track code signal to be passed on without affecting the locomotive's cab signal system. The purpose of the isolation amplifier 104 is to create a high input impedance, non-loading tap of the pickup coil 102 that has a low impedance output, thereby providing noise immunity from inductive interference.

Figure 2:
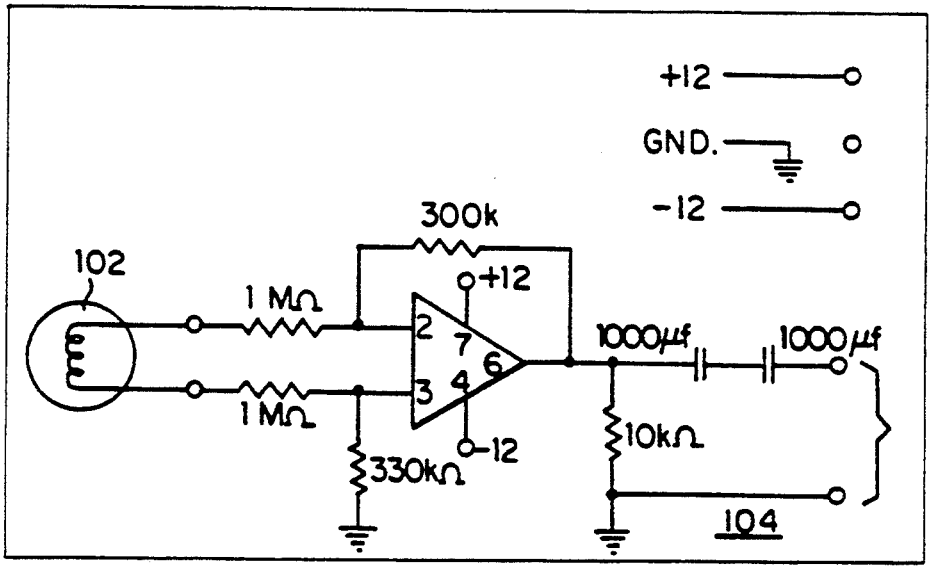
FIG. 2 is a schematic of a preferred embodiment of an external isolation amplifier circuit used in certain embodiments of the present invention.

A preferred embodiment of the isolation amplifier 104 is shown in FIG. 2. Those of ordinary skill will understand that the component values shown are related to the most preferred embodiment of the present invention and that other embodiments will result in different requirements for the resistors and capacitors shown. Most preferably, the isolation amplifier 104 is mounted in a separate chassis and located in the engine compartment as part of the cab portion 100, in close proximity to the pickup coil 102.

Figure 3:
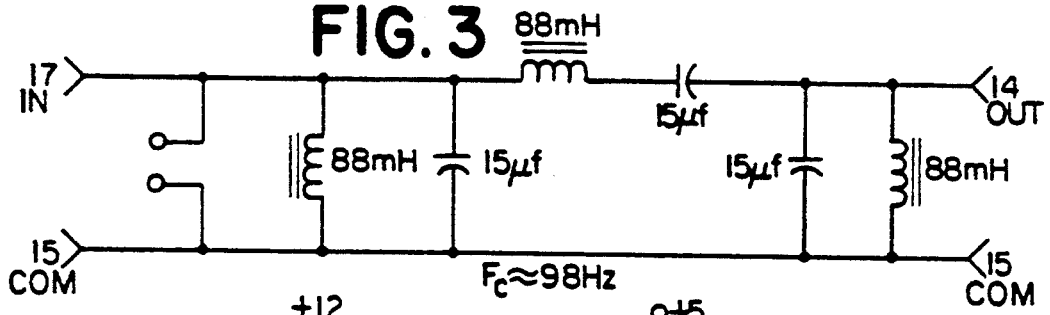
FIG. 3 is a schematic of a preferred embodiment of an LC bandpass filter circuit used in certain embodiments of the present invention.

The analog output signal from the pickup coil 102 is connected, as seen in FIG. 1, to a passive filter network 110 that is most preferably an LC (inductor/capacitor) band-pass filter network. The bandpass filter 110 reduces noise above and below the cab signal carrier frequency and is most preferably disposed outside the cab portion 100, being connected thereto with a shielded cable. A preferred embodiment of the circuit of the LC bandpass filter network 110 and selected component values are shown in FIG. 3. The embodiment illustrated is designed for a center frequency of 98 Hz.

Referring again to FIG. 1, a cab unit 106 is also included within the cab portion 100 of certain embodiments to receive a signal from the pickup coil 102 and convert it to digital form, preferably in a manner to permit data transmission using standard RS 232 serial communication techniques.

Figure 4:
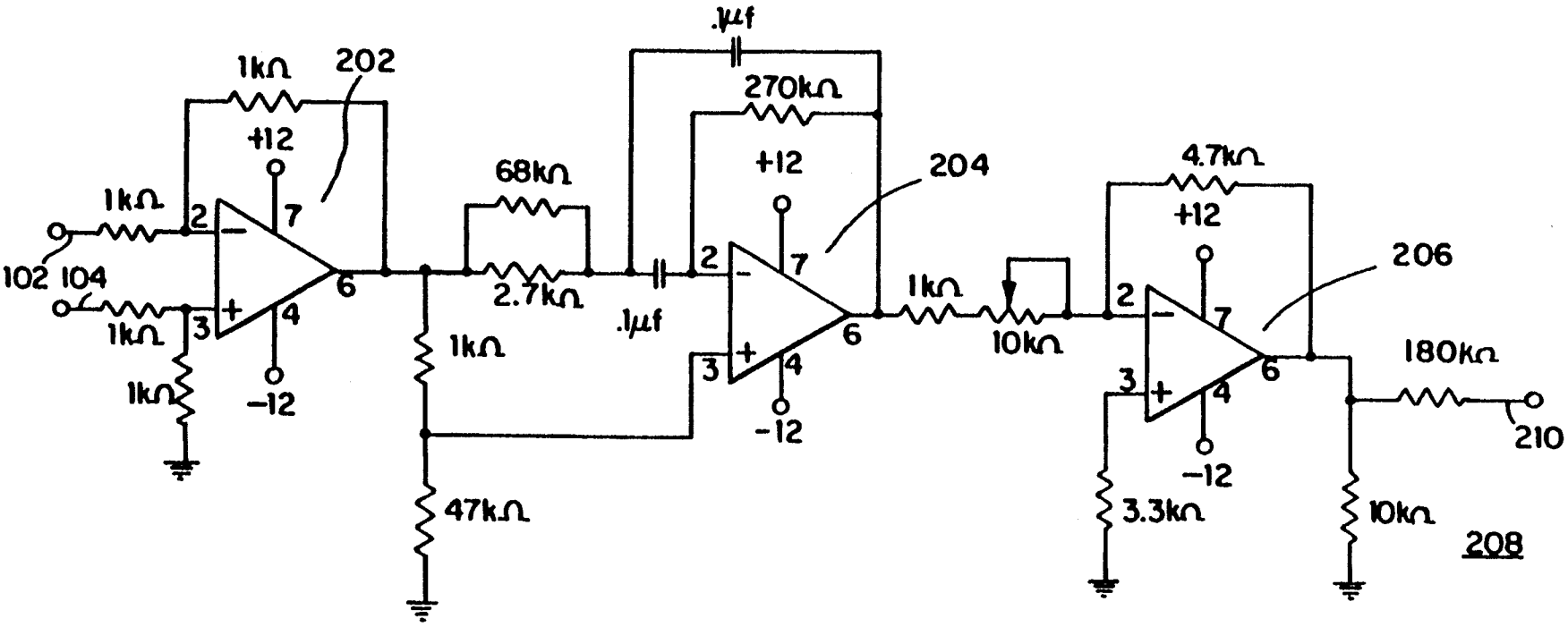
FIG. 4 is a schematic of a preferred embodiment of a signal conditioning circuit in certain embodiments of the present invention.

A component of the present invention that is also typically outside the cab portion 100 described above is the conditioning board 200 that preferably contains a differential amplifier 204 to reject common-mode noise, and an active notch filter 206 that sharply attenuates any noise from commercial power sources that may be present or other sources. Since this noise is generally at 60 Hz, the notch filter 206 is most preferably tuned to 60 Hz. The output of the notch filter 206 is fed into a variable gain amplifier 208 to allow the system of the present invention to be calibrated for a wide range of input signal levels. A schematic of a preferred embodiment of the signal conditioning board is shown in FIG. 4. As explained above, the component values disclosed have been selected based upon the design parameters of the preferred embodiment, for example, the notch frequency chosen is 60.041 Hz, and Q=5 for the embodiment shown. As understood by those of ordinary skill, varying the resistor and capacitor values will effect these parameters, but different combinations could also be chosen in certain embodiments to provided similar frequency and Q values.

As shown in FIG. 1, the output from the signal conditioning board 200 is connected to an analog-to-digital converter 210, provided to convert the analog voltage output signal from the conditioning circuit 200 into a digital signal, preferably by sampling. In a most preferred embodiment the sampling rate is about once per every 500 μs, thereby yielding ten individual, eight bit voltage readings for each cycle of the 100 Hz carrier. A first microprocessor 300 takes a 2.5 second long sample of data every 4 seconds and determines the signal level, carrier frequency, modulation frequency, and duty cycle of the track code. This information is added to the time received from a real-time clock and is transmitted to the system computer 310, discussed below.

In the preferred embodiment of the present invention illustrated in FIG. 1, a second microprocessor 302 controls a 10 second-long rolling buffer of digitized track code that is received from the analog-to-digital converter 210 along with data from the clock 212. This information is transmitted to the system computer 310 whenever it is called for. Thus, track code transient problems such as those that cause the "flips" described above are recorded and stored. These data are then analyzed and displayed by the system computer 310.

Figure 5:
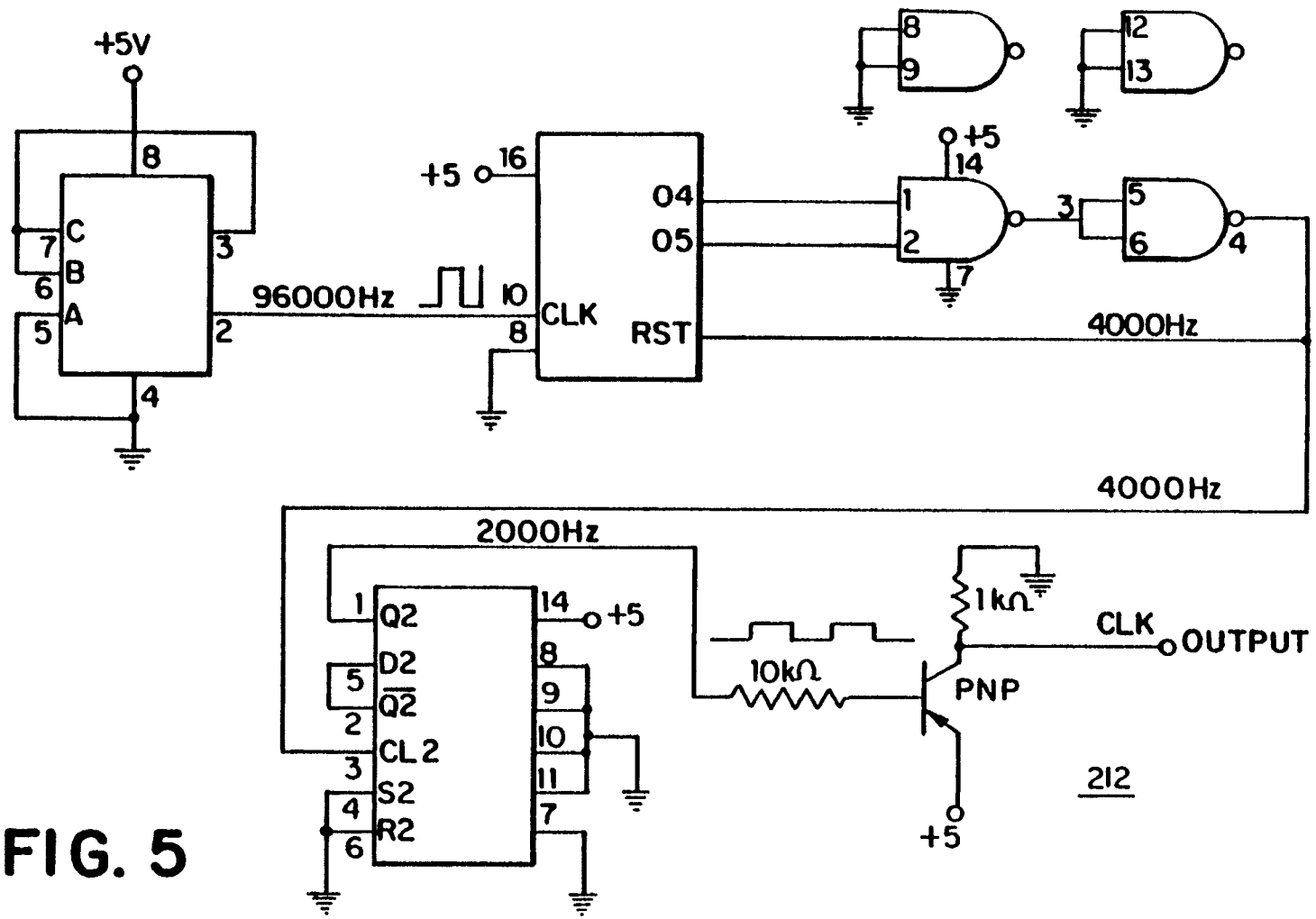
FIG. 5 is a schematic of a preferred embodiment of a clock circuit in certain embodiments of the present invention.

FIG. 5, illustrates a preferred embodiment of a circuit used for the 2 kHz clock 212 that is used to control the analog-to-digital conversion process. The clock circuit shown provides a signal that initiates the analog-to-digital conversion at precisely the time required, preferably every 500 μs and provides an exact square wave output at a 50% duty cycle. The clock 212 most preferably operates at 2000 cycles per second (2 kHz) and thus provides a crystal-based clock signal to externally initiate an analog-to-digital conversion every 500 μs for the signals transmitted to both the first and the second microprocessors 300,302. The output of the clock 212 is most preferably an exact square wave at a 50% duty cycle and can be counted by the first and second microprocessors 300,302 to provide a high resolution time base.

In certain preferred embodiments, a third microprocessor 304 is also provided to interpret the RS 232 output signal from cab units 106 such as the LSL/Ultracab System manufactured by Harmon Electronics. The analysis of the output received from the cab unit 106 determines when cab signal flips have occurred, i.e., when the signal aspect drops and returns in a short time.

A location interface allows train location information taken from an external source to be added to files being recorded by the system computer 310.

Figure 6:
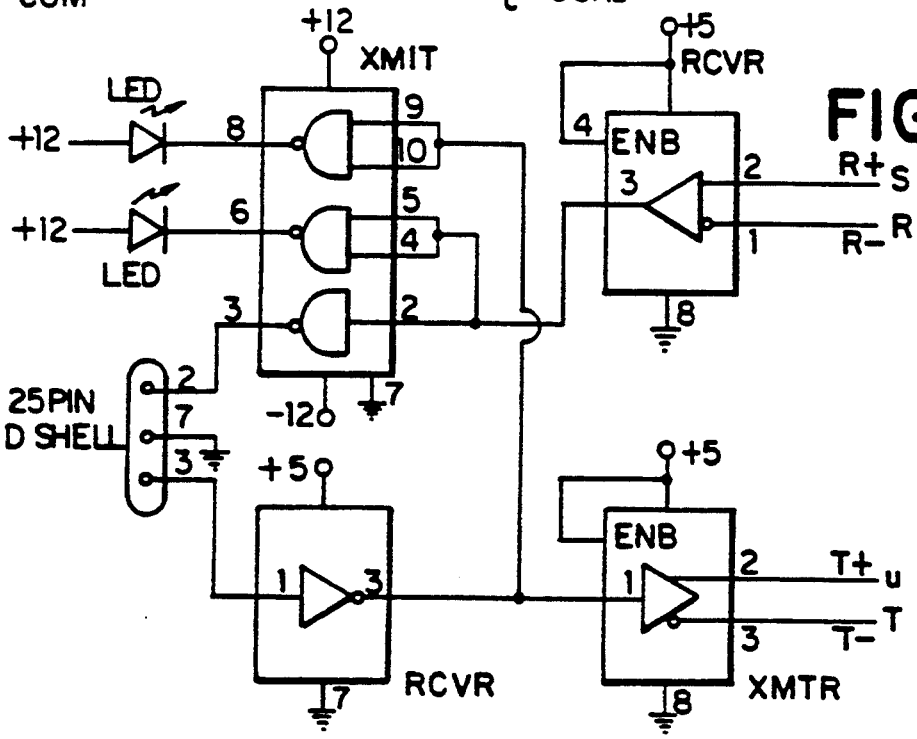
FIG. 6 is a schematic of a preferred embodiment of a communication interface circuit used in certain embodiments of the present invention.

In a preferred embodiment, a communication interface 306 converts data carried on an RS 485 local-area network (LAN) bus to RS 232-C for communication with system computer 310. The LAN carries signals from the first, second and third microprocessors 300,302,304 to the system computer 310. The system computer 310 that controls the present invention is most preferably a DOS-based, IBM-compatible computer with a hard disk drive for mass storage. As will be readily understood by those of ordinary skill, software in the system computer 310 will store and analyze the data sent to it from the microprocessors 300,302,304 and determine the reasons for any out-of-spec condition. For preventative maintenance purposes, somewhat tighter limits are used than those normally used by signal maintainers to reveal incipient problems. The system computer 310 is also able to graphically display the track code files received from the second microprocessor 302. A schematic of a preferred embodiment of the communication interface 306 is shown in FIG. 6. This interface converts the serial port of the system computer 310 to a multiple drop master/slave RS-485 local area network, as is needed to implement certain embodiments of the present invention.

In operation, the track code monitor system of the present invention is, preferably located on a track geometry car that is coupled to the train. Most preferably, the track code monitor system is installed in the lead locomotive and communicates with a cab unit such as the LSL Ultracab signal system through a multi-conductor shielded cable. The cable supplies several signals to the track code monitor: an isolated cab signal track receiver coil output signal, 12 volt DC Power to the systems isolator amplifier 104, and serial communication from the cab unit 106 for anomaly detection.

On the locomotive side, the cab portion 100 has cab signal receiver bar coils located in the pickup coil 102 that are connected to the system's isolation amplifier 104. As described above, the isolation amplifier 104 provides a high impedance coupling that prevents any added load to the cab signal system. The high impedance also eliminates any need to re-calibrate the pick current value of the cab signal receiver. In a preferred embodiment, an RS 232-C1 serial port that is provided on the LSL/Ultracab system or other cab unit 106 serves as the source of the anomaly detection, namely detecting cab signal display flips as required by the system.

On the geometry car, the isolated analog signal from the cab signal receiver of the cab portion 100 is transmitted to a series of filter networks 110 and a conditioning board 200. As described above, the filter network is preferably an LC band-pass filter 110, while the conditioning board most preferably comprises a differential amplifier 204, a 60 Hz notch filter 206, and a variable gain amplifier 208. This is done to provide the cleanest possible analog coded signal to the analog-to-digital converter 210, along with the ability to calibrate the input signal over a wide range of levels, this latter function being provided by the variable gain amplifier 208.

The coded analog signal is converted into a digital signal by the analog-to-digital converter 210. Preferably, the clock 212 provides a clock signal to externally initiate an analog-to-digital conversion exactly every 500 μs. Since the clock 212 preferably operates at 2000 Hz, at the pulse of the clock 212 (every 500 μs), the analog data are converted on the upswing of the clock, and transferred to both the first and the second microprocessors 300,302 on a common data bus 213 on the downswing of the clock 212. The output of the clock 212 is an exact square wave and can be read by both the first and the second microprocessors 300,302 for a high resolution time base.

The first microprocessor 300 is a preventive maintenance diagnostic center that reads the data sent from the analog-to-digital converter 210 on the upswing of the clock 212. A 2.5 second sample of digitized signal data (5000 bytes - 500 μs samples) is taken from the data stream. The entire array of 5000 bytes is stored in the buffer associated with the first microprocessor 300, which then stops taking samples and proceeds to analyze the data in the buffer by performing four discrete tests. The data are most preferably analyzed to determine the following parameters (1) carrier frequency, (2) modulation frequency, (3) duty cycle, and (4) signal level. The first microprocessor 300 also debounces the waveform, via software, and performs software signal conditioning. As readily understood by those of ordinary skill and for purposes of the present invention, "debouncing" comprises eliminating the rapid signal fluctuations that accompany a change of state in mechanical switches, while "signal conditioning" involves the manipulation of outputs into a compatible with or intelligible to another device or program. Thus, when performed in software, signal conditioning might entail operations such as linearization or square root extraction, or include manipulations such as pulse shaping, pulse clipping or digitizing. After the buffer analysis is completed, upon request, the first microprocessor 300 reports the results with a time stamp to the system computer 310. The first microprocessor 300 preferably performs this function about every 4.0 seconds, creating a log of values for later analysis by the system computer 310.

Although the second microprocessor 302 is preferably an identical piece of hardware to the first microprocessor 300, it performs a completely different function. This second microprocessor, like the first microprocessor, reads the same data that are sent from the analog-to-digital converter 210 on the upswing of the clock 212. It then records continuous ("gapless") samples of the digitized data in a 20 Kbytes (i.e, 10 second) rolling buffer. This buffer is transferred to the system computer 310 upon request, such as when an anomaly occurs. These data represent a ten second frame of actual signals that caused the anomaly. Preferably, the sample time is 500 μs per sample with a data resolution of 8 bits.

The third microprocessor 304 is most preferably also an identical piece of hardware to the first and second microprocessors 300,302. It is not, however, connected to the analog-to-digital converter data bus 213 because its program does not process the same digital data. Its function is to monitor the data emanating from the locomotive's LSL/Ultracab signal system generated by the cab unit 106, preferably in RS-232-C1 format. The third microprocessor 304 reads the line data from the cab unit 106 looking for events such as a cab signal flip where the signal aspect drops and returns in a short time, or other interesting changes. Information is transmitted, upon request, to the system computer 310, most preferably over an RS 485 LAN network. When a cab signal flip occurs and is reported to the system computer 310, a 10 second dump of data stored in the rolling buffer of the second microprocessor 302 is requested to determine the cause of the unusual condition. The third microprocessor 304 also has parallel input/output (I/O) port 305 available to read other external inputs and outputs that may be of interest to the system computer 310, namely status LED's, condition information, and the like.

Those of ordinary skill will realize that the communication card found in a typical computer that may be useful as the system computer 310 may be used to convert the serial port of the computer to a multi-drop Master-Slave RS-485 LAN as shown in FIG. 1. In the system of the present invention a typical preferred baud rate is about 9600 baud at 8 bits, with one stop and no parity.

The system computer 310 controls the entire network. It polls the first microprocessor and records all the statistical data. It polls the third microprocessor 304 while waiting for a cab signal flip or any other unusual occurrence to occur. It will record the data sent from the third microprocessor 304 for data analysis. The system host computer 310 is also capable of having anomalies input through is own keyboard. Once an anomaly is detected, the system computer 310 polls the second microprocessor 302 to dump its buffer to a file, creating what is termed an "anomaly dump." Each anomaly dump preferably has its own separate file for easy evaluation. The system computer 310 then analyzes the three respective files described above and generates the following:

1. List of trouble spots
2. Graphs of general activity
3. Graphs of anomalies to find specific cause of problems.

Although certain embodiments of the present invention have been set forth herein with particularity, these embodiments are meant as examples only and do not limit the present invention. Upon review of the description of the invention set forth above, those of ordinary skill will realize many adaptations, modifications and useful variants of the methods and apparatus disclosed that are in keeping with the spirit of the present invention. For this reason, reference should be made to the appended claims in order to ascertain the true scope of the present invention.

What is claimed is:

1. Apparatus for processing a track code signal for indicating track conditions comprising:

a pickup for inductively receiving and decoding an analog track code signal;

a conditioning circuit for processing the analog track code signal;

a converter for creating a digital track code signal;

a first processor in the form of a microprocessor for inputing the digital track code signal, computing values representative of the characteristics of said signal, and transmitting a first output signal indicative of said values wherein the microprocessor takes data from the analog-to-digital converter and determines signal level, carrier frequency, modulation frequency, and duty cycle of the track code; and apparatus for displaying said values, whereby the values are indicative of the track conditions.

2. The apparatus of claim 1, further comprising a clock connected to the convertor, wherein the processor receives a clock signal and computes a value at a plurality of predetermined times governed by the clock.

3. The apparatus of claim 2, further comprising: a second processor connected to the clock, the second processor configured to receive an input from the converter, determine if an anomaly is present and create a second output signal indicative of the presence of the anomaly;

a cab unit connected to the pickup for providing a digital cab monitor track code signal; and a third processor configured to receive an input from the cab unit, determine the presence of a signal flip and create a third output signal indicative of the signal flip.

4. The apparatus of claim 3, further comprising a system computer and a local area network, wherein the first, second and third output signals are transmitted along the local area network to the system computer.

5. The apparatus of claim 4, further comprising a communication interface connected to the local area network for converting the first, second and third output signals into a form compatible with an RS 232 serial communication device.

6. The apparatus of claim 1, wherein the apparatus for displaying comprises one or more light emitting diodes.

7. The apparatus of claim 1 further comprising a power supply connected to at least the conditioning circuit and the converter.

8. The apparatus of claim 7, wherein the power supply comprises a battery storage device.

9. The apparatus of claim 7, further comprising an isolation amplifier for creating high input impedance, non-loading tap of the pickup coil that has a low impedance output, thereby providing noise immunity from inductive interference, the isolation amplifier connected to the pickup and the power supply, the isolation amplifier having an output comprising the analog track code signal.

10. The apparatus of claim 1, further comprising a band pass filter connected to the pickup, the band pass filter having an output connected to the conditioning circuit.

11. The apparatus of claim 10, wherein the bandpass filter comprises at least an inductor and a capacitor, whereby the bandpass filter reduces noise above and below the cab signal carrier frequency and has a center frequency of about 98 Hz.

12. The apparatus of claim 1, wherein the conditioning circuit comprises a differential amplifier for amplifying the analog track code signal; a notch filter connected to an output signal from the differential amplifier and a variable gain amplifier connected to the output of the notch filter.

13. The apparatus of claim 12 wherein the notch filter is tuned to 60 Hz.

14. A track code analyzer for measuring one or more parameters from the group consisting of: duty cycle, modulation frequency, and amplitude, comprising:

means for determining when one or more of said parameters are outside predetermined limits;

means for detecting transient track code anomalies; and means for recording transient track code anomalies.

15. Apparatus for processing a track code signal for indicating track conditions comprising:

a pickup for inductively receiving and decoding an analog track code signal;

a conditioning circuit for processing the analog track code signal;

a converter for creating a digital track code signal;

a first processor, comprising a microprocessor for taking data from the analog-to-digital converter and determining signal level, carrier frequency, modulation frequency, and duty cycle of the track code, for computing a value from the digital track code signal and transmitting a first output signal indicative of the value; and apparatus for displaying the value, whereby the value is indicative of the track code conditions.

16. The apparatus of claim 15, further comprising:

a second processor connected to the clock, the second processor configured to receive an input from the converter, determine if an anomaly is present and create a second output signal indicative of the presence of the anomaly;

a cab unit connected to the pickup for providing a digital cab monitor track code signal; and a third processor configured to receive an input from the cab unit, determine the presence of a signal flip and create a third output signal indicative of the signal flip.

17. The apparatus of claim 16, further comprising a system computer and a local area network, wherein the first, second and third output signals are transmitted along the local area network to the system computer.

18. The apparatus of claim 17, further comprising a communication interface connected to the local area network for converting the first, second and third output signals into a form compatible with an RS 232 serial communication device.

* * * * *